US007223116B2

(12) United States Patent
Brandl et al.

(10) Patent No.: US 7,223,116 B2
(45) Date of Patent: May 29, 2007

(54) INSULATION PIERCING CONNECTING DEVICE

(75) Inventors: Wolfgang Brandl, Amberg (DE); Peter Donhauser, Amberg (DE); Alfred Fischer, Schwandorf (DE); Ludwig Niebler, Laaber (DE)

(73) Assignee: Siemens Aktiengesellschaft, Munich (DE)

( * ) Notice: Subject to any disclaimer, the term of this patent is extended or adjusted under 35 U.S.C. 154(b) by 469 days.

(21) Appl. No.: 10/344,753

(22) PCT Filed: Aug. 3, 2001

(86) PCT No.: PCT/DE01/02975

§ 371 (c)(1),
(2), (4) Date: Feb. 14, 2003

(87) PCT Pub. No.: WO02/15338
PCT Pub. Date: Feb. 21, 2002

(65) Prior Publication Data

US 2003/0176098 A1 Sep. 18, 2003

(30) Foreign Application Priority Data

Aug. 16, 2000 (DE) ..... 100 39 963

(51) Int. Cl.
*H01R 11/20* (2006.01)

(52) U.S. Cl. ..... 439/409; 439/391; 439/410

(58) Field of Classification Search ..... 439/391, 439/417, 829, 409, 410, 393
See application file for complete search history.

(56) References Cited

U.S. PATENT DOCUMENTS

| | | | | |
|---|---|---|---|---|
| 4,370,009 | A * | 1/1983 | Dola | 439/177 |
| 4,466,682 | A | 8/1984 | Jusseau et al. | 439/391 |
| 4,728,295 | A * | 3/1988 | Henrici et al. | 439/84 |
| 5,993,244 | A * | 11/1999 | Bechaz et al. | 439/417 |
| 6,183,288 | B1 * | 2/2001 | Barrat et al. | 439/409 |
| 6,196,883 | B1 * | 3/2001 | Bechaz et al. | 439/789 |

FOREIGN PATENT DOCUMENTS

| | | |
|---|---|---|
| DE | 19628116 | 10/1997 |
| DE | 19732182 | 3/1999 |
| DE | 19956750 | 6/2000 |

* cited by examiner

*Primary Examiner*—Michael C. Zarroli
(74) *Attorney, Agent, or Firm*—Harness, Dickey & Pierce, P.L.C.

(57) ABSTRACT

An insulation piercing connector (2) is held inside a base body (1), and a closing element (3) is guided inside said base body. The closing element can be transferred into a closed position at least from one open position, in which a conductor (4) can be inserted into the closing element (3). By transferring the closing element (3) into the closed position, the conductor (4) can be inserted into the insulation piercing connector (2) and can be held and clamped therein. An over spring (7) is arranged on the closing element (3). Said over spring surrounds the insulation piercing connector (2) and contacts the same via contact pieces (8) whereby exerting a pressure force (F) onto the insulation piercing connector (2).

22 Claims, 2 Drawing Sheets

INSULATION PIERCING CONNECTING DEVICE

This application is the national phase under 35 U.S.C. § 371 of PCT International Application No. PCT/DE01/02975 which has an International filing date of Aug. 3, 2001, which designated the United States of America and which claims priority on German Patent Application number DE 100 39 963.0 filed Aug. 16, 2000, the entire contents of which are hereby incorporated herein by reference.

FIELD OF THE INVENTION

The present invention generally relates to an insulation piercing connecting device with a base body, an insulation piercing connector which is held in the base body and a closing element which is guided by the base body and can be transferred at least from one open position into a closed position. Preferably, it is possible in the open position for a conductor to be inserted into the closing element and it is possible by transferring the closing element into the closed position for a conductor, which has been inserted into the closing element, to be inserted into the insulation piercing connector and held and clamped by the insulation piercing connector. The insulation piercing connector is preferably surrounded by an over spring which contacts the insulation piercing connector with contact pieces and thereby exerts a pressing force on the insulation piercing connector.

BACKGROUND OF THE INVENTION

An insulation piercing connecting device is known for example from DE 197 32 182 C1. On it, the over spring is rigidly connected to the insulation piercing connector.

SUMMARY OF THE INVENTION

An object of an embodiment of the present invention is to provide an improved insulation piercing connecting device.

An object may be achieved by the over spring being arranged on the closing element, so that in the open position the contact pieces contact the insulation piercing connector in opening contact regions and in the closed position they contact it in closing contact regions.

This is because it is made possible in this way to vary the action of the over spring on the insulation piercing connector.

If the closing element and the over spring are integrally connected to each other, the insulation piercing connecting device is constructed in a particularly simple form.

If the closing element and the over spring are formed as a punched/bent part, the production of the closing element and the over spring is particularly simple.

The actuation of the closing element is possible particularly easily if a bearing element for an actuating tool is formed onto the closing element. In this case, the bearing element is preferably also a component part of the punched/bent part.

If the insulation piercing connector between the opening contact regions and the closing contact regions is formed in such a way that the pressing force varies when the closing element is transferred from the open position into the closed position, the exertion of force onto the insulation piercing connector can be adapted to the respective position of the closing element between the open position and the closed position.

If the insulation piercing connector in the opening contact regions and/or the closing contact regions and the contact pieces are formed in such a way that the pressing force is minimal in the open position and/or the closed position, the open position and/or the closed position form preferential positions. Consequently, reaching them can be sensed by a tactile device or tactilly. Minimizing the pressing force can be achieved, for example, by the insulation piercing connector being narrowed in a curved manner in the opening contact regions and/or the closing contact regions. The contact pieces are preferably narrowed in a way which corresponds thereto.

BRIEF DESCRIPTION OF THE DRAWINGS

Further advantages and details emerge from the following description of an exemplary embodiment in conjunction with the drawings, which constitute a basic representation and in which.

DETAILED DESCRIPTION OF THE PREFERRED EMBODIMENTS

Figure 1:
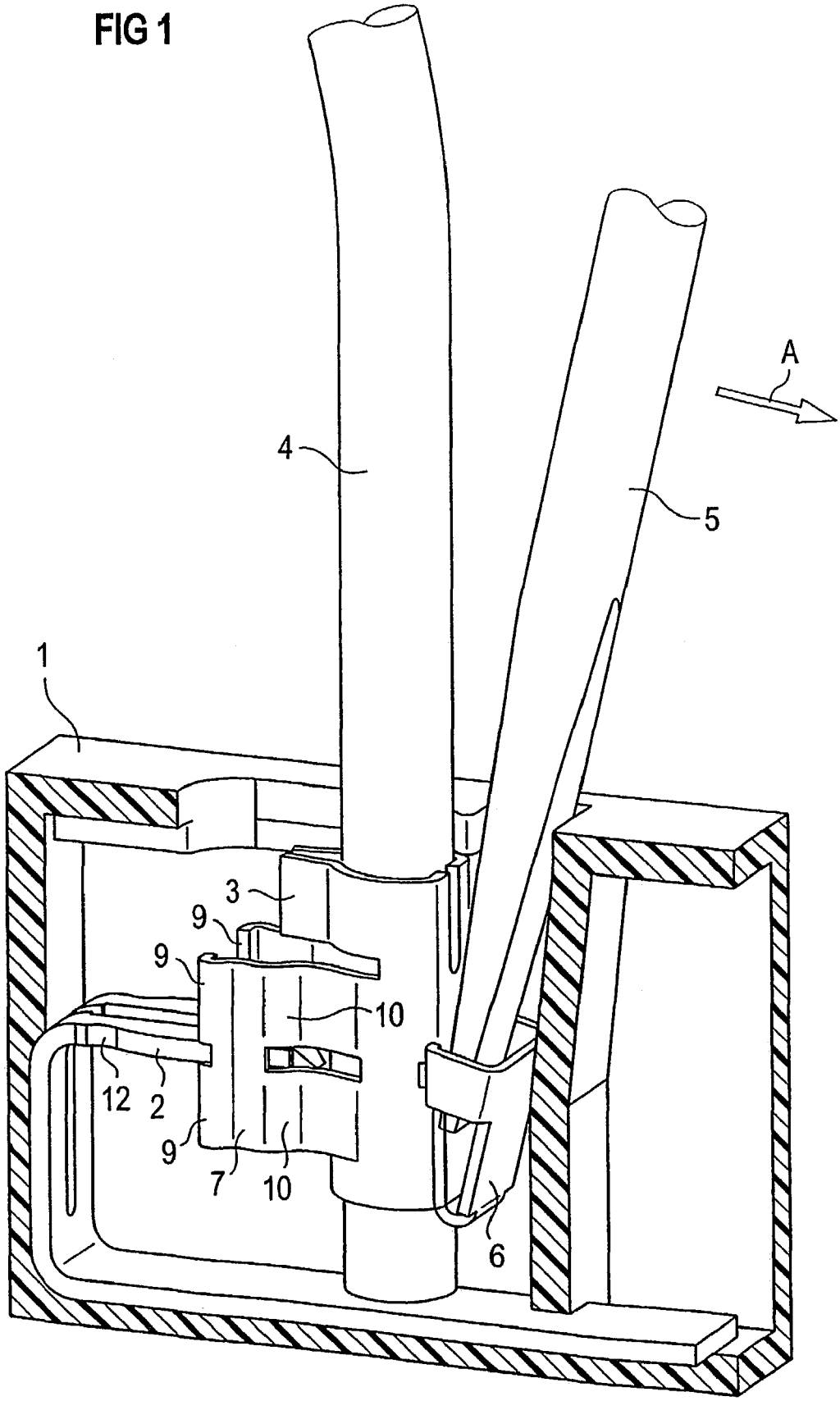
FIG. 1 shows an insulation piercing connecting device with a closing element, conductor and operating tool
Figure 2:
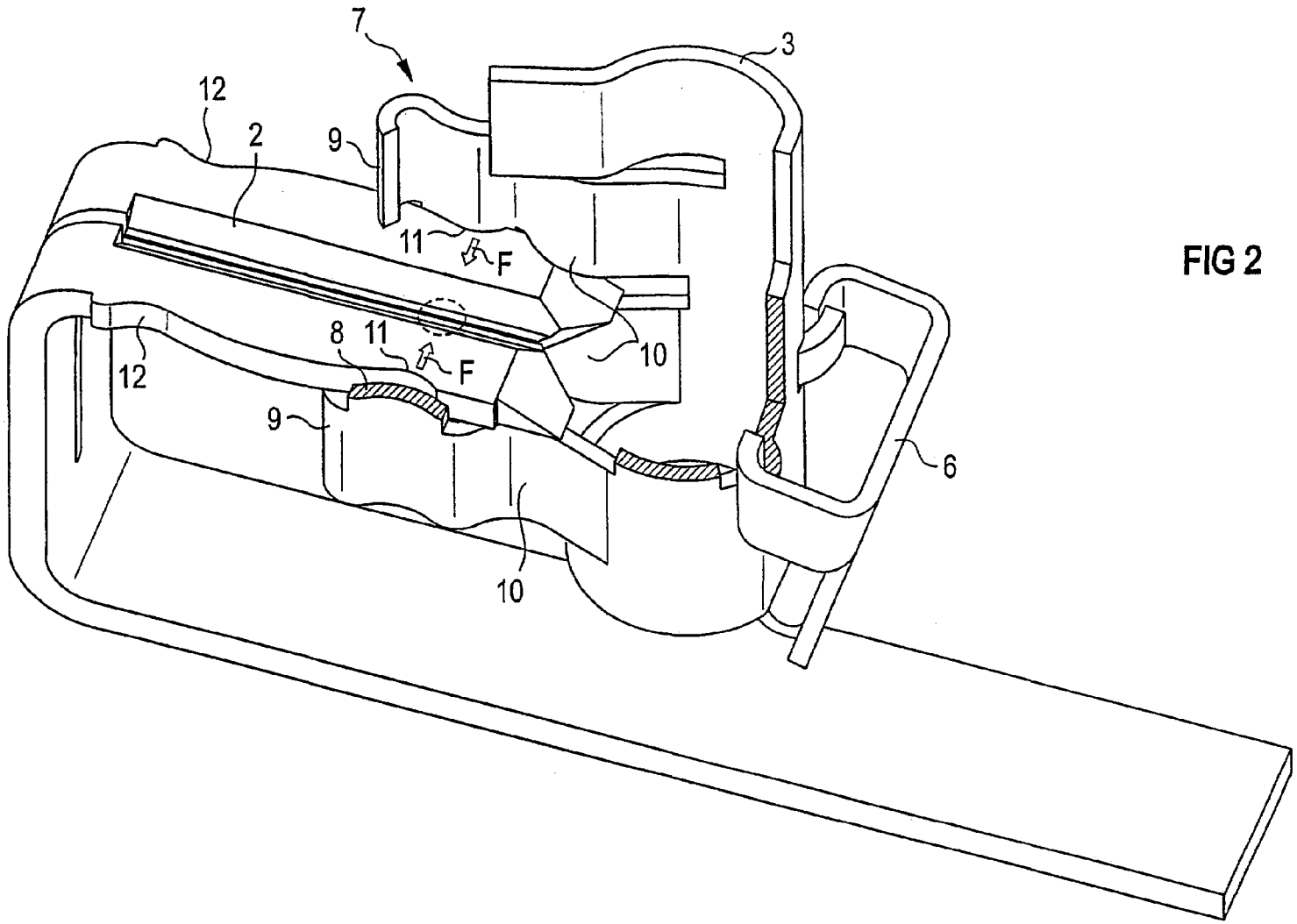
FIG. 2 shows an insulation piercing connector with a closing element.

According to FIG. 1, an insulation piercing connecting device has a base body 1. Held in the base body 1 is an insulation piercing connector 2. The insulation piercing connecting device also has a closing element 3. In FIGS. 1 and 2, the closing element 3 is represented in an open position. In the open position, a single-core conductor 4, which does not have to be stripped, can be inserted into the closing element 3.

The closing element 3 can be transferred from the open position into a closed position. For this purpose, an actuating tool 5, generally a customary screwdriver, is inserted into a bearing element 6, which is formed onto the closing element 3. By pivoting the actuating tool 5 in an actuating direction A, the closing element 3 is then transferred into the closed position. The conductor 4 is thereby inserted into the insulation piercing connector 2 and is held and clamped by the latter in the closed position. The position of the conductor 4 in the closed position is symbolized in FIG. 2 by a circle indicated by dashed lines.

Arranged on the closing element 3 is an over spring 7, which surrounds the insulation piercing connector 2. The over spring 7 thereby contacts the insulation piercing connector 2 with contact pieces 8 and therefore exerts a pressing force F on the insulation piercing connector 2. On account of the way in which the over spring 7 is formed, in particular on account of the presence of front wrap-around lugs 9 and rear wrap-around lugs 10, the over spring 7 thereby forms at the same time a guiding element, on account of which the closing element 3 is guided with respect to the insulation piercing connector 2 and consequently ultimately also in the base body 1.

On account of the arrangement of the over spring 7 on the closing element 3, the over spring 7 is moved together with the closing element 3. In the open position of the closing element 3, the contact pieces 8 therefore contact the insulation piercing connector in opening contact regions 11, in the closed position they contact it in closing contact regions 12. It is evident here that the closing element 3 and the over spring 7 are integrally connected to each other. In particular, the closing element 3, the bearing element 6 and the over spring 7 are formed as an (integral) punched/bent part.

According to FIG. 2, the insulation piercing connector 2 is narrowed in a curved manner in the opening contact regions 11 and closing contact regions 12. The contact pieces 8 are also narrowed in a curved manner corresponding thereto. This way of forming the insulation piercing connector 2 and the over spring 7 achieves the effect that the pressing force F in these two positions is minimal. Consequently, preferential positions are produced, the reaching of which can be sensed by a tactile device or tactilly.

Between the open position and the closed position, on the other hand, the insulation piercing connector 2 is widened in a convex manner. As a result, when the closing element 3 is transferred from the open position into the closed position, the pressing force F is varied according to the convex profile of the insulation piercing connector 2.

With the insulation piercing connecting device according to an embodiment of the invention, a series of advantages can be achieved. In particular, the pressing force F can be adapted to the individual process steps, and changed, when transferring from the open position into the closed position (firstly insertion and piercing of the insulation, then contacting of the conductor 4). It is consequently possible to realize a force characteristic which is optimized to the individual process steps and permits ergonomically favorable actuation. By minimizing the pressing force F in the two end positions of the clamping element 3, reaching these two positions can on the one hand be reliably brought about and on the other hand sensed by a tactile device or tactilly. As a result, both the actuating forces and the displacement distances can be reduced. Consequently, a relatively small overall volume of the insulation piercing connecting device is obtained. Finally, the insulation piercing connecting device according to the invention can also be used in a greater cross-sectional range than comparable insulation piercing connecting devices of the prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An insulation piercing connecting device, comprising:

an insulation piercing connector, held in a base body;

a closing element, guided in the base body and transferable at least from one open position into a closed position, wherein, in the open position, a conductor is insertable into the closing element and wherein, by transferring the closing element into the closed position, a conductor inserted into the closing element is insertable into the insulation piercing connector to be held by the insulation piercing connector; and an over spring, surrounding the insulation piercing connector and contacting the insulation piercing connector via contact pieces and thereby exerting a pressing force on the insulation piercing connector, wherein the over spring is arranged on the closing element so that, in the open position, the contact pieces contact the insulation piercing connector in opening contact regions and in the closed position, contact the insulation piercing connector in closing contact regions.

2. The insulation piercing connecting device as claimed in claim 1, wherein the closing element and the over spring are integrally connected.

3. The insulation piercing connecting device as claimed in claim 2, wherein the closing element and the over spring are formed as at least one of a punched part and a bent part.

4. The insulation piercing connecting device as claimed in claim 2, wherein a bearing element for an actuating tool is formed onto the closing element.

5. The insulation piercing connecting device as claimed in claim 4, wherein the closing element and the over spring are formed as at least one of a punched part and a bent part and wherein the bearing element is also a component part of at least one of the punched part and bent part.

6. The insulation piercing connecting device of claim 1, wherein the insulation piercing connector between the opening contact regions and the closing contact regions is formed in such a way that the pressing force varies when the closing element is transferred from the open position into the closed position.

7. The insulation piercing connecting device as claimed in claim 1, wherein the insulation piercing connector in at least one of the opening contact regions and the closing contact regions, and the contact pieces are formed in such a way that the pressing force is minimal in at least one of the open position and the closed position.

8. The insulation piercing connecting device as claimed in claim 7, wherein the insulation piercing connector is narrowed in a curved manner in at least one of the opening contact regions and the closing contact regions.

9. The insulation piercing connecting device as claimed in claim 8, wherein the contact pieces are correspondingly narrowed in a curved manner.

10. The insulation piercing connecting device as claimed in claim 3, wherein a bearing element for an actuating tool is formed onto the closing element.

11. The insulation piercing connecting device as claimed in claim 1, wherein a bearing element for an actuating tool is formed onto the closing element.

12. The insulation piercing connecting device as claimed in claim 3, wherein a bearing element is also a component part of at least one of the punched part and bent part.

13. The insulation piercing connecting device of claim 2, wherein the insulation piercing connector between the opening contact regions and the closing contact regions is formed in such a way that the pressing force varies when the closing element is transferred from the open position into the closed position.

14. The insulation piercing connecting device of claim 3, wherein the insulation piercing connector between the opening contact regions and the closing contact regions is formed in such a way that the pressing force varies when the closing element is transferred from the open position into the closed position.

15. The insulation piercing connecting device of claim 4, wherein the insulation piercing connector between the opening contact regions and the closing contact regions is formed in such a way that the pressing force varies when the closing element is transferred from the open position into the closed position.

16. The insulation piercing connecting device of claim 5, wherein the insulation piercing connector between the opening contact regions and the closing contact regions is formed in such a way that the pressing force varies when the closing element is transferred from the open position into the closed position.

17. The insulation piercing connecting device as claimed in claim 2, wherein the insulation piercing connector in at least one of the opening contact regions and the closing contact regions, and the contact pieces are formed in such a way that the pressing force is minimal in at least one of the open position and the closed position.

18. The insulation piercing connecting device as claimed in claim 17, wherein the insulation piercing connector is narrowed in a curved manner in at least one of the opening contact regions and the closing contact regions.

19. The insulation piercing connecting device as claimed in claim 18, wherein the contact pieces are correspondingly narrowed in a curved manner.

20. A connecting device, comprising:

a connector, held in a body;

a closing element, guided in the body and moveable at least from one open position into a closed position, wherein, in the open position, a conductor is insertable into the closing element and wherein, by moving the closing element into the closed position, a conductor inserted into the closing element is insertable into and then held by the connector; and spring means, located external to the connector and contacting the connector via contact pieces, for exerting a pressing force on the connector, wherein the spring means is arranged on the closing element so that, in the open position, the contact pieces contact the connector in opening contact regions and in the closed position, contact the connector in closing contact regions, wherein the connector in at least one of the opening contact regions and the closing contact regions, and the contact pieces are formed in such a way that the pressing force is minimal in at least one of the open position and the closed position and wherein the connector is narrowed in a curved manner in at least one of the opening contact regions and the closing contact regions.

21. The connector as claimed in claim 20, wherein the closing element and the spring means are integrally connected.

22. The connector as claimed in claim 20, wherein the contact pieces are correspondingly narrowed in a curved manner.

* * * * *